US008151508B1

(12) United States Patent
Moore

(10) Patent No.: US 8,151,508 B1
(45) Date of Patent: Apr. 10, 2012

(54) RIFLE SCOPE ALIGNMENT DEVICE

(76) Inventor: Robert L. Moore, Avella, PA (US)

( * ) Notice: Subject to any disclaimer, the term of this patent is extended or adjusted under 35 U.S.C. 154(b) by 0 days.

(21) Appl. No.: 13/048,129

(22) Filed: Mar. 15, 2011

(51) Int. Cl.
*F41G 1/387* (2006.01)

(52) U.S. Cl. ..... 42/124

(58) Field of Classification Search ..... 42/119, 42/124, 125, 126, 127
See application file for complete search history.

(56) References Cited

U.S. PATENT DOCUMENTS

| | | | | |
|---|---|---|---|---|
| 960,813 | A * | 6/1910 | Burton | 42/124 |
| 2,767,473 | A | 10/1956 | Craven | |
| 3,037,288 | A | 6/1962 | Detrich et al. | |
| 3,750,318 | A * | 8/1973 | Burris | 42/127 |
| 4,249,315 | A | 2/1981 | Hopson, III | |
| 4,825,258 | A | 4/1989 | Whitson | |
| 5,400,539 | A * | 3/1995 | Moore | 42/127 |
| 5,433,010 | A * | 7/1995 | Bell | 42/126 |
| 5,522,166 | A * | 6/1996 | Martel | 42/124 |
| 5,771,595 | A | 6/1998 | Bell | |
| 5,878,504 | A | 3/1999 | Harms | |
| 6,813,855 | B2 | 11/2004 | Pinkley | |
| 7,062,876 | B2 | 6/2006 | Wilson | |
| 7,121,037 | B2 | 10/2006 | Penney | |
| 7,140,143 | B1 | 11/2006 | Ivey | |
| 2001/0027620 | A1 * | 10/2001 | Wooten et al. | 42/124 |

* cited by examiner

*Primary Examiner* — Bret Hayes
(74) *Attorney, Agent, or Firm* — Montgomery Patent & Design, LLC; Robert C. Montgomery; Joseph T. Yaksich

(57) ABSTRACT

A rifle scope alignment device includes a telescopic sight and a mount to position and align a crosshair reticule in a repeatable manner. The device includes a mounting rail, a pair of clamping brackets, and a scope. The mounting rail is coupled to a barrel of a firearm, preferably a rifle, and provides attachment of the clamping brackets. At least one lower clamping bracket has a spring-loaded ball bearing designed to engage a corresponding slot machined into an exterior of the scope. This interaction establishes an accurate and repeatable alignment of the scope and an internal crosshair reticule.

13 Claims, 7 Drawing Sheets

RIFLE SCOPE ALIGNMENT DEVICE

RELATED APPLICATIONS

The present invention was first described in a notarized Official Record of Invention on Jun. 7, 2010, that is on file at the offices of Montgomery Patent and Design, LLC, the entire disclosures of which are incorporated herein by reference.

FIELD OF THE INVENTION

The present invention relates generally telescopic sights, and in particular, to an alignment device for mounting a scope to a firearm.

BACKGROUND OF THE INVENTION

Over the years, modern advances in hunting equipment have enhanced the sport, providing hunters with increased success. Among these products, scopes used on high-powered rifles offer long-range targeting capabilities with exceptional accuracies. However, as with most precision equipment, they require meticulous set-up and calibration. Should the scope be removed from the rifle, this calibration must be performed all over again, each time.

While there have been attempts to provide various releasable mounting mechanisms and quick-release scope mounts, they typically do not provide for repeatable accuracy related to the particular orientation of the scope within the mount and can over time develop "play" as parts begin to wear. Additionally, various other devices attempt to provide adjustment mechanisms between the scope mount and the scope, such that once the scope is mounted to the rifle it can be reoriented to provide an accurate sight picture or so windage and elevation adjustments can be made.

Examples of these devices can be seen by reference in the following U.S. patents: U.S. Pat. No. 2,767,473 issued to Craven discloses a detachable scope mount for guns; U.S. Pat. No. 3,037,288 issued to Detrich et al. discloses a magnetic mount for gun sights; U.S. Pat. No. 4,249,315 issued to Hopson, III discloses a gun scope mount system; U.S. Pat. No. 5,771,595 issued to Bell discloses a scope tube adjusting and locking device; and, U.S. Pat. No. 7,062,876 issued to Wilson discloses a rifle scope mounting means.

Additionally, other devices have attempted to provide ways to properly adjust the sight picture provided by the scope. Examples of these attempts can be seen by reference in U.S. Pat. No. 4,825,258 issued to Whitson discloses a device for bore alignment of gun sights; U.S. Pat. No. 5,878,504 issued to Harms discloses a rifle scope vertical alignment apparatus and method; and, U.S. Pat. No. 6,813,855 issued to Pinkley discloses a gun sight reticule alignment.

While these attempts may achieve their purported objective each suffers from one or more disadvantage or deficiency related to design or utilization. Particularly, each of the devices require post-mounting adjustment of the scope and fail to provide accurate and repeatable positioning of the scope relative to the crosshair reticule in a simple and quick manner.

SUMMARY OF THE INVENTION

The inventor has therefore recognized the aforementioned inherent problems and lack in the art and observed that there is a need for a device which permits rapid removal and replacement of telescopic sights on rifles while maintaining exceptional and repeatable accuracy. In accordance with the invention, it is an object of the present disclosure to solve these problems.

The inventor recognized these problems and has addressed this need by developing a rifle scope alignment device which allows a user to quickly remove, exchange, or replace a telescopic sight on rifles in a manner which is easy, effective, and accurate. The inventor has thus realized the advantages and benefits of providing a scope having a linear alignment slot disposed in an exterior surface and a mounting rail fastened to a firearm for securing the scope. A first lower bracket is adjustably coupled to the mounting rail to support a proximal end of the scope. The first lower bracket includes an alignment mechanism adapted to engage the alignment slot to prohibit rotational motion of the scope within the first lower bracket. A second lower bracket is also adjustably coupled to the mounting rail to support a distal end of the scope. A first upper bracket is fastened to the first lower bracket to encircle the scope proximal end and a second upper bracket is fastened to the second lower bracket to encircle the scope distal end.

In at least one (1) embodiment, the first lower bracket includes a semi-circular first lower ring, a first lower fastening ear disposed on each opposing end of the first lower ring, and a first lower fastening aperture disposed through each of the first lower fastening ears for fastening of the upper bracket. A connecting first slide protrudes from an exterior of the first lower ring and is slidably inserted into a channel disposed longitudinally through a top surface of the mounting rail. The alignment mechanism is disposed completely through the first slide.

In at least one (1) embodiment, the alignment mechanism includes a threaded set screw socket disposed at a bottom end of the first slide extending at least partially through a center of the first slide. A ball and spring socket is disposed at a center of an interior of the first ring and extends through to the set screw socket. A threaded set screw is adjustably fastened within the set screw socket. A spring is disposed within the ball and spring socket and a bottom end of the spring is in contact with the set screw. A ball bearing is provided and is disposed within the ball and spring socket and also in contact with an upper end of the spring. The ball bearing at least partially protrudes through the first lower ring interior to insertingly engage the orientation slot in the scope. The ball bearing is also retractable within the ball and spring socket in response to an applied downward force.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

| | |
|---|---|
| 10 | rifle scope alignment device |
| 20 | first lower bracket |
| 21 | second lower bracket |
| 22 | first lower ring |
| 23 | second lower ring |
| 24 | first lower fastening ear |
| 25 | second lower fastening ear |
| 26 | first lower fastening aperture |
| 27 | second lower fastening aperture |
| 30 | first slide |
| 31 | second slide |
| 32 | ball bearing |
| 33 | spring |
| 34 | set screw |
| 36 | set screw socket |
| 37 | ball and spring socket |
| 40 | upper bracket |
| 42 | upper ring |
| 44 | upper fastening ear |
| 46 | upper fastening aperture |
| 60 | mounting rail |
| 62 | rail tightening knob |
| 80 | scope |
| 82 | scope body |
| 84 | focal ring |
| 86 | crosshair reticule |
| 88 | sun shade |
| 90 | sighting adjustment knob |
| 92 | orientation slot |
| 100 | rifle |
| 105 | rifle barrel |
| 110 | rifle stock |
| 180 | modified scope |
| 200 | fastener |
| 250 | retrofit embodiment |
| 260 | alternate upper bracket |
| 270 | alternate first lower bracket |
| 275 | alternate second lower bracket |
| 280 | alternate mounting rail |
| 285 | alternate rail tightening knob |

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Figure 5B:
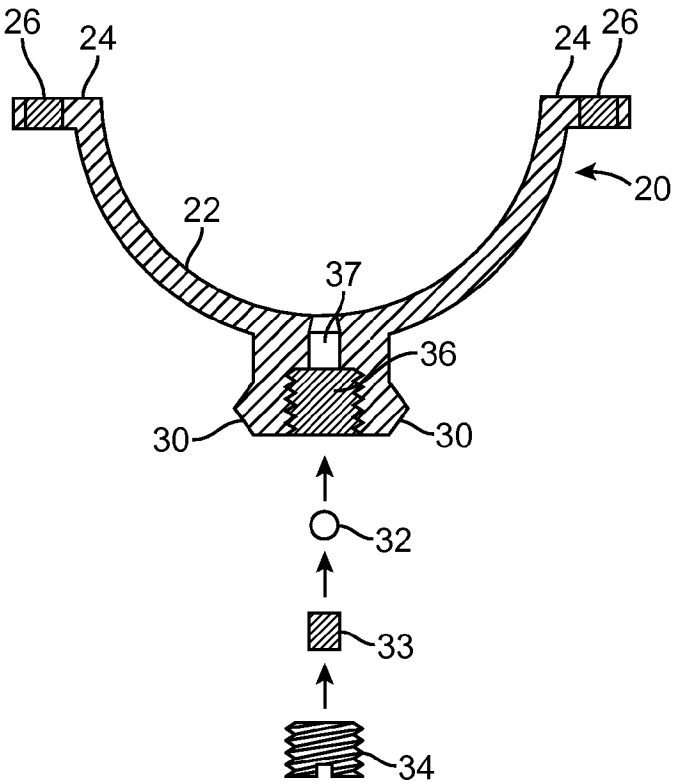
FIG. 5*b* is an exploded section view of the first lower bracket taken along section line A-A of FIG. 2, according to the preferred embodiment; and, FIG. 6 is a side view of a retrofit embodiment depicted as installed upon the rifle and a modified scope, according to an alternate embodiment in accordance with the invention.
Figure 5A:
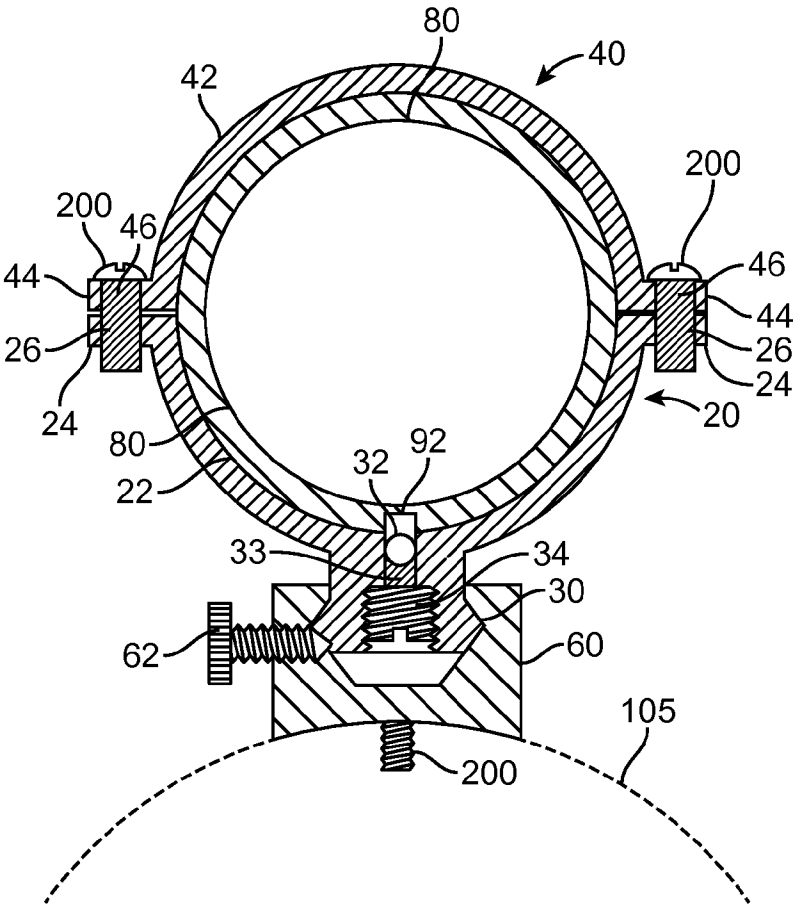
FIG. 5*a* is a section view of the rifle scope alignment device taken along section line A-A of FIG. 2, according to the preferred embodiment.
Figure 6:
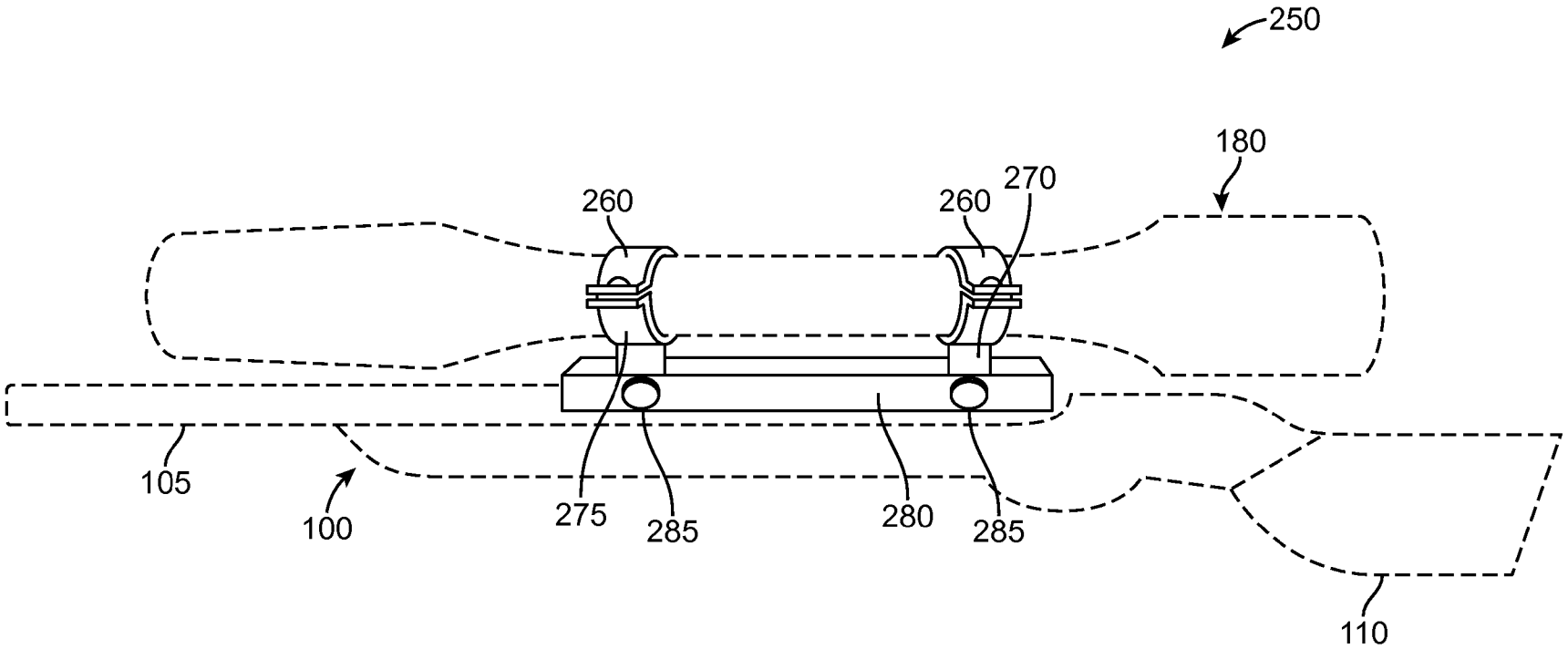

Referring now to FIGS. 1 through 5, depicting a rifle scope alignment device (herein described as a "device") 10 and FIG. 6, depicting a retrofit embodiment 250, where like reference numerals represent similar or like parts. The device 10 includes a scope 80 having a crosshair reticule 86 and a plurality of brackets for mounting and aligning the device 10 on the rifle in an accurate and repeatable manner. The device 10 is shown as being utilized on a conventional hunting rifle 100 for illustration. The rifle 100 generally includes expected features such as, but not limited to, a rifle barrel 105, a stock 110, and other features expected as part of a firearm.

Figure 1:
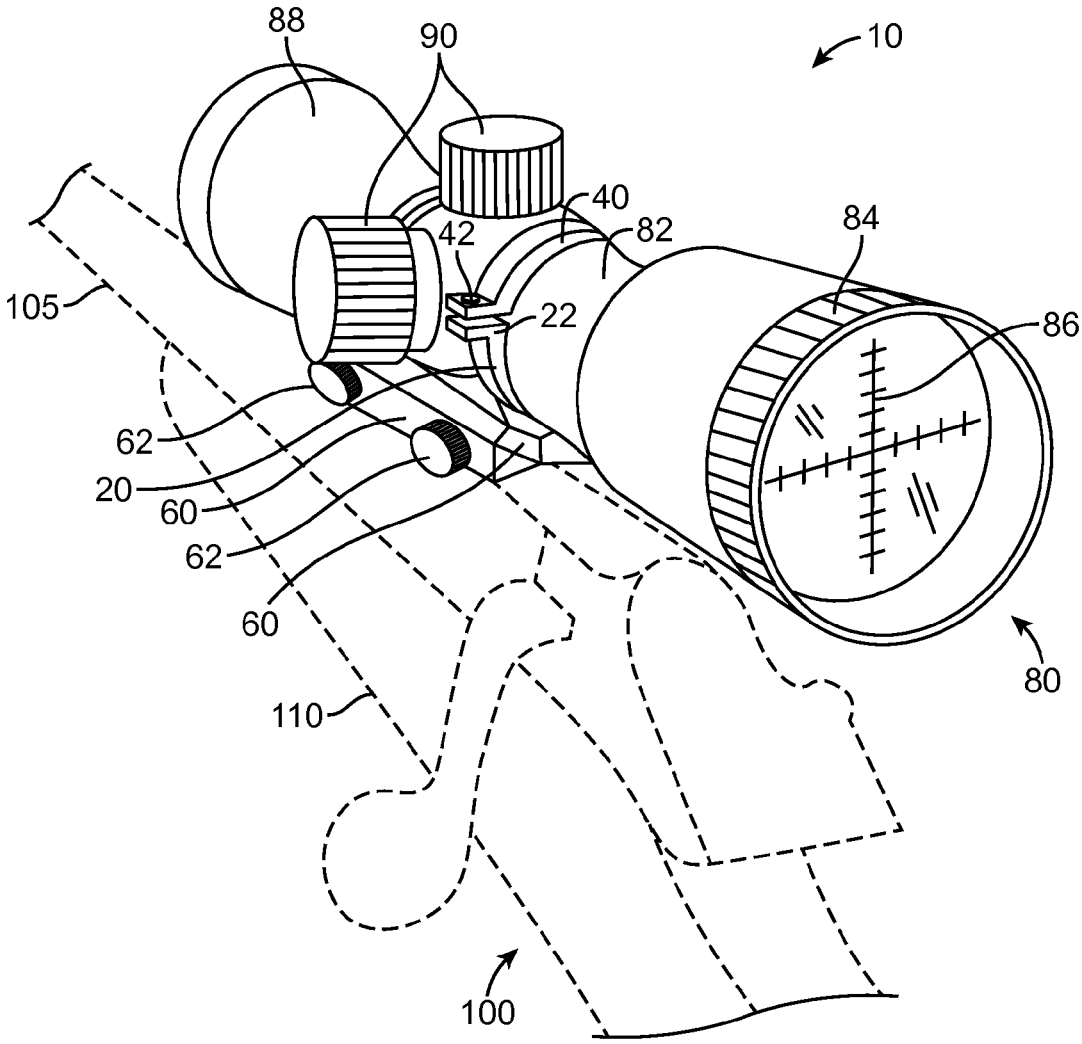
FIG. 1 is a perspective view of a rifle scope alignment device depicted as installed upon a rifle, according to a preferred embodiment in accordance with the invention.
Figure 2:
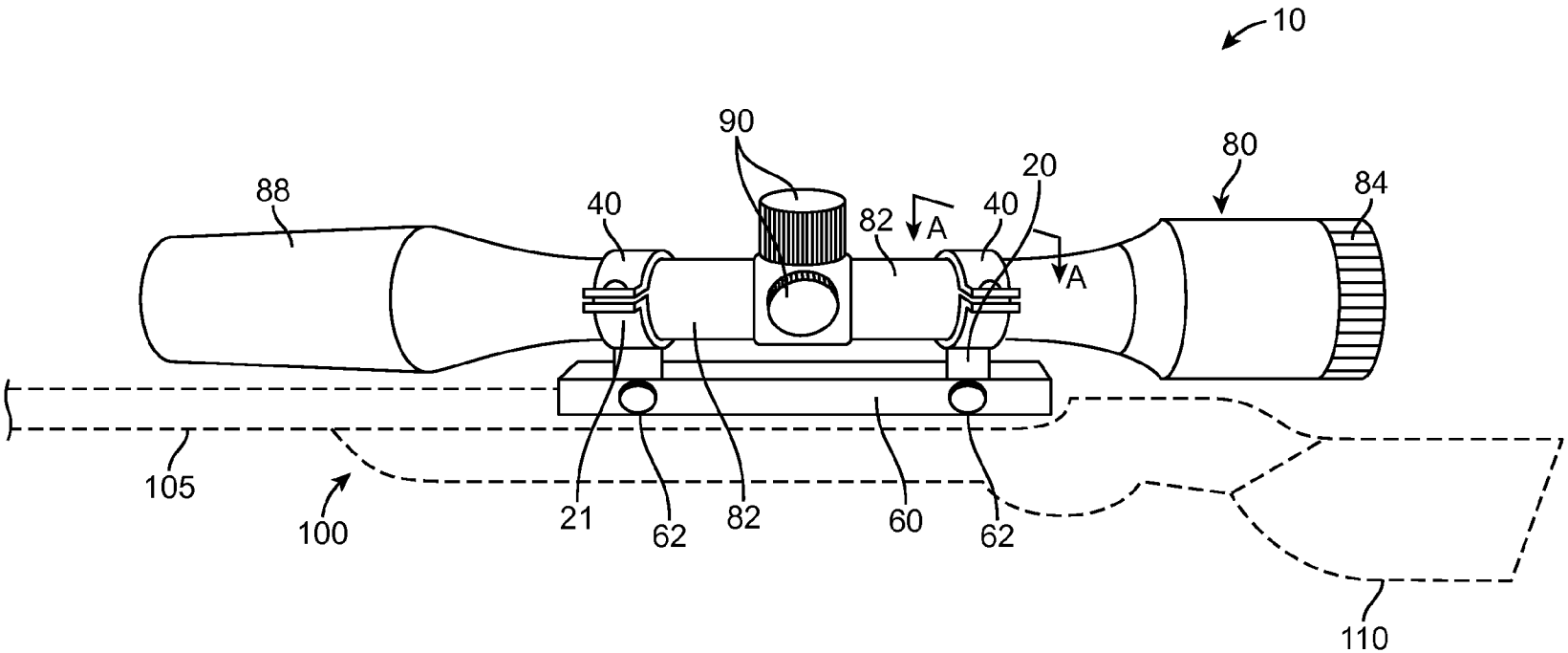
FIG. 2 is a side view of the rifle scope alignment device, according to the preferred embodiment.

FIGS. 1 and 2 show environmental views of the device 10, depicted as installed upon a rifle 100. The scope 80 is mounted to a rifle barrel 105 using a plurality of ring-type brackets and a stationary mounting rail 60. The mounting brackets are two-piece circular units connected around the scope 80 at proximal and distal locations. The brackets more particularly include a first lower bracket 20 to support the proximal end of the scope 80 and a second lower bracket 21 to support the distal end of the scope 80. The lower brackets 20, 21 provide a lower clamp half to hold and secure the scope 80 upon the rifle 100. A respective semi-circular upper bracket 40 is fastened to each lower bracket 20, 21 to enclosure the scope 80. The first lower bracket 20 also includes a spring-loaded ball bearing 32 that engages a corresponding linear orientation slot 92 disposed along a bottom surface of the scope 80 (see FIGS. 3 and 4).

Figure 3A:
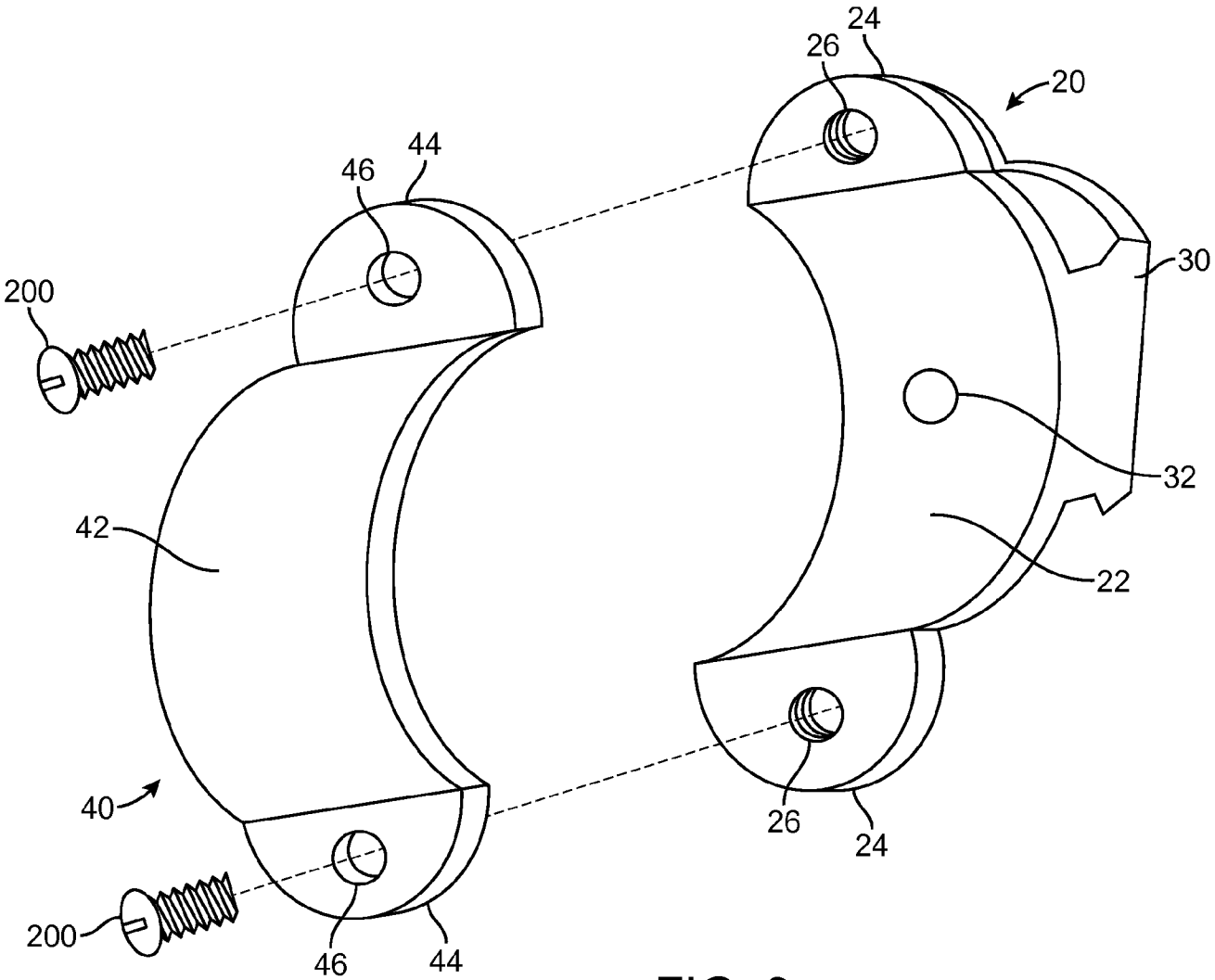
FIG. 3*a* is a close-up view of a first lower bracket and an upper bracket, according to the preferred embodiment.
Figure 3B:
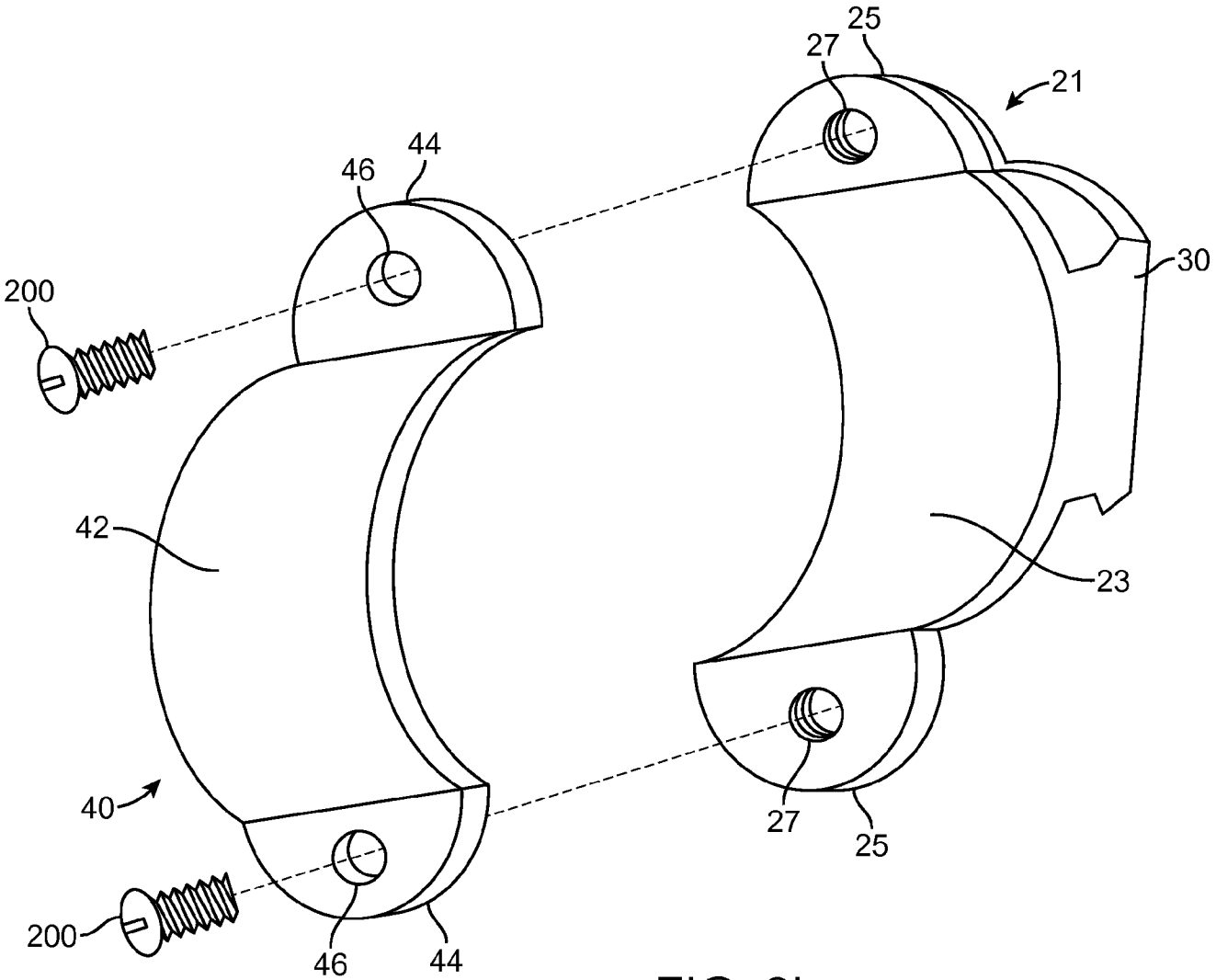
FIG. 3*b* is a close-up view of a second lower bracket and the upper bracket, according to the preferred embodiment.

FIGS. 3*a* and 3*b* show close-up views of the first lower bracket 20, second lower bracket 21, and upper bracket 40. The first lower bracket 20, second lower bracket 21, and upper bracket 40 are preferably similar in materials and design to conventional models of brackets providing a semi-circular clamping opening to clamp and secure a generally cylindrical article. The first lower bracket 20 includes a semi-circular first lower ring 22, a pair of opposing coplanar first lower fastening ears 24, a pair of threaded first lower fastening apertures 26, a ball bearing 32, and a connecting first slide 30. The first slide 30 provides for the accurate attachment of the first lower bracket 20 to a subjacent mounting rail 60 (see FIG. 5*a*). The ball bearing 32 engages the corresponding orientation slot 92 which is preferably machined into the exterior of the scope 80, thereby quickly establishing an accurate rotational position of the scope 80 in a repeatable and accurate engagement (see FIG. 4). The engagement of the ball bearing 32 and slot 92 provides accurate positioning of the crosshair reticule 86 along a vertical and horizontal axis within the scope 80 relative to the rifle barrel 105 (see FIG. 5*a*).

The second lower bracket 21 includes a second lower ring 23, a pair of second lower fastening ears 25, a second lower fastening aperture 27 through each second lower fastening ear 25, and a connecting second slide 31. The second lower bracket 21 has substantially similar construction and clamping function as described for the first lower bracket 20, excluding the ball bearing 32 and associated features of the first slide feature 30.

The connecting first slide 30 and the second slide 31 of are preferably a dual "V"-type slide feature; however, it can be appreciated by one skilled in the art that various methods of accurately attaching the lower brackets 20, 21 to the mounting rail 40 or the rifle 100 can be utilized without deviating from the scope of the invention and as such should not be interpreted as a limiting factor. These alternative attachment methods include, but are not limited to, dovetail rails, WEAVER®-type horizontal grooved mounts, one-piece bracket and rail combinations, and the like. Both the first lower bracket 20 and second lower bracket 21 work in conjunction with the respective upper bracket 40 to clamp and secure the scope 80 into the desired position.

The upper bracket 40 includes an upper ring 42, a pair of upper fastening ears 44, and a drilled upper fastening aperture 46 through each upper fastening ear 44. Each upper bracket 40 correspondingly mates and is fastened to the respective lower bracket 20, 21 by pairs of fasteners 200. The fasteners 200 are preferably any appropriate mechanical fastener including, but not limited to: bolts, screws, or the like. The lower brackets 20, 21 and upper brackets 40 combine to form a circular opening along a common axis, thereby providing an interfering clamping affect when tightened around the exterior of a scope body 82 (see FIGS. 1 and 2).

Figure 4:
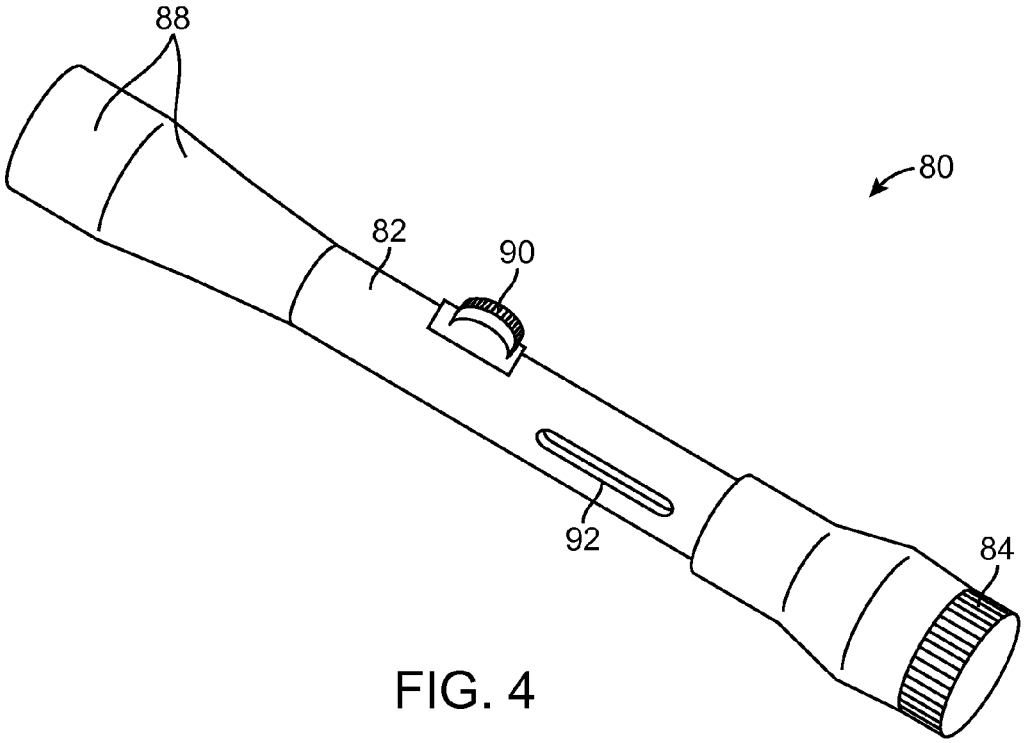
FIG. 4 is a perspective view of a scope, according to the preferred embodiment.

FIG. 4 shows a perspective view of the scope 80. The scope 80 is envisioned to include expected features found on traditional telescopic scopes including, but not limited to, the elongated cylindrical scope body 82, a focal ring 84 located at a proximal end, a sun shade 88 located at a distal end, the internal reticule 86, a pair of sighting adjustment knobs 90, and the like (see FIGS. 1 and 2). In addition, the scope 80 provides particular enhancements to enable accurate alignment of an internal crosshair reticule portion 86 by a specific mechanical engagement to the mounting first lower bracket 20. Particularly, the orientation slot 92 is disposed linearly along a bottom exterior surface of the scope body 82 corresponding to an angular position of the crosshair reticule 86.

The orientation slot 92 includes a groove feature having a cross-sectional shape being rectangular, semi-circular, "V"-shaped, or the like and approximately one-sixteenth (1/16) inch in depth and approximately one-eighth (1/8) inch in width. The orientation slot 92 is envisioned being formed into the scope body 82 using manufacturing and machining processes such as, but not limited to, machined using a flat, round, or "V"-shaped milling tool, swaged during a tube forming process, or the like. The orientation slot 92 includes a particular width which provides for the insertable engagement of the ball bearing 32 within. This engagement results in the restricted or prohibited rotational motion of the scope 80 within the first lower bracket brackets 20 and the upper bracket 40. Furthermore, the orientation slot 92 extends linearly along a longitudinal axis of the scope 80 approximately two (2) inches in length. The slot 92 allows for linear adjustment of the scope 80 along a longitudinal axis of the rifle barrel 105 to obtain a desired "eye-to-scope" distance without compromising the restricted rotational position of the scope 80 when mounted.

FIGS. 5*a* and 5*b* show section and exploded views of a first lower bracket 20 taken along section line A-A of FIG. 2. The ball bearing 32 is coupled to a spring 33 and the combined spring 30 and ball bearing 32 are retractably fit within a drilled spring socket 37. A set screw 34 is threadingly fastened upwardly into a set screw socket 36 which is located directly below the ball and spring socket 37. A spring force acts from below upon the ball bearing 32 by the subjacent spring 33 which is in turn compressed and retained by threaded insertion of the subjacent set screw 34. The set screw socket 36 and a ball and spring socket 37 portions are preferably machined into the first lower bracket 20 along a bottom surface. The ball and spring socket 37 also includes a top opening which allows for the partial exposure of the ball bearing 32 which at least partially protrudes above an inner surface of the lower ring 22. Upon installation of the scope 80 between the first lower bracket 20 and the upper bracket 40, the ball bearing 32 insertingly engages the orientation slot 92 (see FIG. 5*a*).

The mounting rail 60 includes a rectangular plate which is fastened to a top surface of the rifle barrel 105 using a plurality of fasteners 200. The mounting rail 60 includes features along a top surface which provide for the sliding attachment of the corresponding slide features 30, 31 of the respective lower brackets 20, 21. The lower brackets 20, 21 are in turn secured to the mounting rail 60 by threaded engagement and tightening of a plurality of rail tightening knobs 62 against side surfaces of the slide features 30, 31.

FIG. 6 shows a retrofit embodiment 250. In accordance with the invention, it can be appreciated that the teachings of the present disclosure can also be utilized by applying the features included in the mounting rail 60, the lower brackets 20, 21 and the upper bracket 40 to an existing modified scope 180 with equal benefit. The modified scope 180 can be machined in a particular manner so as to include the orientation slot 92 located along a bottom surface of the modified scope 180 without interfering with its functionality. The slot 92 is created using a flat, round, or "V"-shaped milling tool to form a cross-sectional shape being rectangular, semi-circular, "V"-shaped which is approximately one-thirty-second (1/32) of an inch in depth and approximately one-eighth (1/8) inch in width. The retrofit embodiment 250 includes a pair of alternate upper brackets 260, an alternate first lower bracket 270, an alternate second lower bracket 275, an alternate mounting rail 280, and a pair of alternate rail tightening knobs 285, all of which provide similar construction, materials, and function as the corresponding elements of the previously described preferred embodiment 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner following installation of the mounting rail portion 60 upon the rifle 100 by a qualified gunsmith. After initial purchase or acquisition of the device 10, it would be installed as indicated in FIGS. 1 and 2.

The method of installing and utilizing the device 10 may be achieved by performing the following steps: procuring a model of the device 10 having desired characteristics such as reticule style 86, magnification power, and the like; installing the mounting rail 60 upon the rifle barrel 105 using the fasteners 200; inserting the first slide feature 30 into the receiving channel of the mounting rail 60, inserting the second slide feature 31 into the mounting rail 60; adjusting a position of the first lower bracket 20 and second lower bracket 21 along the mounting rail 60; securing the first lower bracket 20 and second lower bracket 21 to the mounting rail 60 by tightening the rail tightening knobs 62; placing the scope body 82 downwardly into the first lower bracket 20 and second lower bracket 21; rotating the scope 80 until obtaining mechanical engagement of the ball bearing 32 into the orientation slot 92; installing the upper brackets 40 loosely onto respective lower brackets 20, 21 using the fasteners 200; sliding the scope 80 along its longitudinal axis to obtain a desired eye-to-scope distance; tightening the upper brackets 40 onto the respective lower brackets 20, 21 using the fasteners 200, thereby securing the scope 80 in place; utilizing the device 10 to perform a hunting or wildlife activities in a normal manner; and, benefiting from resultant shooting accuracy due to a properly aligned crosshair reticule portion 86 afforded a user of the device 10.

The method of installing and utilizing the retrofit embodiment 250 may be achieved by performing the following additional steps: performing machining of the modified scope 180 to provide the orientation slot 92 along the bottom surface, taking care to accurately locate the slot 92 with regards to the internal crosshair reticule portion 86 of the modified scope 180; aligning the crosshair reticule 86 in like manner as the previously described preferred embodiment of the device 10; securing the modified scope 180 to the alternate brackets 260, 270, 275 and alternate mounting rail 280 in like manner as the corresponding portions of the preferred embodiment of the device 10 as described above; and, utilizing the retrofit embodiment 250 in like manner as the preferred embodiment of the device 10 to perform hunting or similar activities.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A rifle scope alignment device comprising:

a scope having a linear alignment slot disposed in an exterior surface;

a mounting rail fastened to a firearm, further comprising:

a longitudinal channel through an upper surface thereof; and, at least one first rail tightening knob threadably fastened to at least one exterior side;

a first lower bracket adjustably coupled to said mounting rail to support a proximal end of said scope, said first lower bracket comprising an alignment mechanism adapted to engage said alignment slot to prohibit rotational motion of said scope within said first lower bracket, further comprising:

a semi-circular first lower ring;

a first lower fastening ear disposed on each opposing end of said first lower ring;

a first lower fastening aperture disposed through each of said first lower fastening ears; and, a connecting first slide protruding from an exterior of said first lower ring and slidably inserted into said channel;

a second lower bracket adjustably coupled to said mounting rail to support a distal end of said scope;

a first upper bracket fastened to said first lower bracket to encircle said scope proximal end; and, a second upper bracket fastened to said second lower bracket to encircle said scope distal end;

wherein said longitudinal channel adjustably receives said first lower bracket and said second lower bracket;

wherein an end of said at least one first rail tightening knob at least partially protrudes through said channel to engage said first slide to secure said first lower bracket in a stationary position; and, wherein said alignment mechanism is disposed through said first slide and further comprises:

a threaded set screw socket disposed at a bottom end of said first slide extending at least partially through a center of said first slide;

a ball and spring socket disposed at a center of an interior of said first ring and extending to said set screw socket;

a threaded set screw adjustably fastened within said set screw socket;

a spring disposed within said ball and spring socket and in contact with said set screw; and, a ball bearing disposed within said ball and spring socket and in contact with said spring;

wherein said ball bearing at least partially protrudes through said first lower ring interior to insertingly engage said orientation slot; and, wherein said ball bearing is retractable within said ball and spring socket in response to a downward force.

2. The device of claim 1, wherein each of said upper brackets further comprises:

a semi-circular upper ring;

an upper fastening ear disposed on each opposing end of said upper ring; and, an upper fastening aperture disposed through each of said upper fastening ears;

wherein said upper fastening apertures align with said lower fastening apertures to fasten said upper bracket to said lower bracket.

3. The device of claim 2, wherein said orientation slot is located at a prescribed location relative to an orientation of a crosshair reticule of said scope.

4. The device of claim 3, wherein said set screw is threadingly positioned within said set screw socket to adjust a spring force applied to said ball bearing by said spring.

5. The device of claim 4, wherein said second lower bracket further comprises:

a semi-circular second lower ring;

a second lower fastening ear disposed on each opposing end of said second lower ring;

a second lower fastening aperture disposed through each of said second lower fastening ears; and, a connecting second slide protruding from an exterior of said second lower ring and slidably inserted into said channel.

6. The device of claim 5, wherein said mounting rail further comprises at least one second rail tightening knob threadably fastened to said at least one exterior side;

wherein an end of said at least one second rail tightening knob at least partially protrudes through said channel to engage said second lower bracket to secure in a stationary position.

7. A rifle scope alignment device for use with a telescopic scope modified by having a linear alignment slot created on an exterior surface, wherein said orientation slot is located at a prescribed location relative to an orientation of a crosshair reticule of said scope, said device comprising:

a mounting rail fastened to a firearm, further comprising:

a longitudinal channel through an upper surface thereof; and, at least one first rail tightening knob threadably fastened to at least one exterior side;

a first lower bracket adjustably coupled to said mounting rail to support a proximal end of said scope, said first lower bracket comprising an alignment mechanism adapted to engage said alignment slot to prohibit rotational motion of said scope within said first lower bracket, further comprising:

a semi-circular first lower ring;

a first lower fastening ear disposed on each opposing end of said first lower ring;

a first lower fastening aperture disposed through each of said first lower fastening ears; and, a connecting first slide protruding from an exterior of said first lower ring and slidably inserted into said channel;

a second lower bracket adjustably coupled to said mounting rail to support a distal end of said scope;

a first upper bracket fastened to said first lower bracket to encircle said scope proximal end; and, a second upper bracket fastened to said second lower bracket to encircle said scope distal end;

wherein said longitudinal channel adjustably receives said first lower bracket and said second lower bracket;

wherein an end of said at least one first rail tightening knob at least partially protrudes through said channel to engage said first slide to secure said first lower bracket in a stationary position; and, wherein said alignment mechanism is disposed through said first slide and further comprises:

a threaded set screw socket disposed at a bottom end of said first slide extending at least partially through a center of said first slide;

a ball and spring socket disposed at a center of an interior of said first ring and extending to said set screw socket;

a threaded set screw adjustably fastened within said set screw socket;

a spring disposed within said ball and spring socket and in contact with said set screw;

a ball bearing disposed within said ball and spring socket and in contact with said spring;

wherein said ball bearing at least partially protrudes through said first lower ring interior to insertingly engage said orientation slot; and, wherein said ball bearing is retractable within said ball and spring socket in response to a downward force.

8. The device of claim 7, wherein said mounting rail further comprises for adjustably receiving said first lower bracket and said second lower bracket.

9. The device of claim 7, wherein each of said upper brackets further comprises:

a semi-circular upper ring;

an upper fastening ear disposed on each opposing end of said upper ring; and, an upper fastening aperture disposed through each of said upper fastening ears;

wherein said upper fastening apertures align with said lower fastening apertures to fasten said upper bracket to said lower bracket.

10. The device of claim 9, wherein said set screw is threadingly positioned within said set screw socket to adjust a spring force applied to said ball bearing by said spring.

11. The device of claim 10, wherein said second lower bracket further comprises:

a semi-circular second lower ring;

a second lower fastening ear disposed on each opposing end of said second lower ring;

a second lower fastening aperture disposed through each of said second lower fastening ears; and, a connecting second slide protruding from an exterior of said second lower ring and slidably inserted into said channel.

12. The device of claim 11, wherein said mounting rail further comprises at least one second rail tightening knob threadably fastened to said at least one exterior side;

wherein an end of said at least one second rail tightening knob at least partially protrudes through said channel to engage said second lower bracket to secure in a stationary position.

13. A method of mounting a scope to a firearm, wherein said scope is mounted such that a crosshair reticule of said scope is repeatably oriented to a prescribed position, said method comprising the steps of:

providing said scope having a linear alignment slot disposed in an exterior surface;

providing a rifle scope alignment device comprising:

a mounting rail fastened to a firearm, further comprising:

a longitudinal channel through an upper surface thereof; and, at least one first rail tightening knob threadably fastened to at least one exterior side;

a first lower bracket adjustably coupled to said mounting rail to support a proximal end of said scope, said first lower bracket comprising an alignment mechanism adapted to engage said alignment slot to prohibit rotational motion of said scope within said first lower bracket, further comprising:

a semi-circular first lower ring;

a first lower fastening ear disposed on each opposing end of said first lower ring;

a first lower fastening aperture disposed through each of said first lower fastening ears; and, a connecting first slide protruding from an exterior of said first lower ring and slidably inserted into said channel;

a second lower bracket adjustably coupled to said mounting rail to support a distal end of said scope;

a first upper bracket fastened to said first lower bracket to encircle said scope proximal end; and, a second upper bracket fastened to said second lower bracket to encircle said scope distal end;

wherein said longitudinal channel adjustably receives said first lower bracket and said second lower bracket;

wherein an end of said at least one first rail tightening knob at least partially protrudes through said channel to engage said first slide to secure said first lower bracket in a stationary position; and, wherein said alignment mechanism is disposed through said first slide and further comprises:

a threaded set screw socket disposed at a bottom end of said first slide extending at least partially through a center of said first slide;

a ball and spring socket disposed at a center of an interior of said first ring and extending to said set screw socket;

a threaded set screw adjustably fastened within said set screw socket;

a spring disposed within said ball and spring socket and in contact with said set screw;

a ball bearing disposed within said ball and spring socket and in contact with said spring;

wherein said ball bearing at least partially protrudes through said first lower ring interior to insertingly engage said orientation slot; and, wherein said ball bearing is retractable within said ball and spring socket in response to a downward force;

fastening said mounting rail to said firearm;

adjustably coupling said first lower bracket to said mounting rail;

adjustably coupling said second lower bracket to said mounting rail;

placing said scope within said lower brackets such that said first lower bracket supports said proximal end and said second lower bracket supports said distal end;

fastening said first upper bracket to said first lower bracket around said scope proximal end;

fastening said second upper bracket to said second lower bracket around said scope distal end; and, rotating said scope until said alignment mechanism engages said orientation slot.

* * * * *